US011149471B2

(12) United States Patent
Nguyen et al.

(10) Patent No.: US 11,149,471 B2
(45) Date of Patent: Oct. 19, 2021

(54) PADLOCK

(71) Applicant: RYNAN TECHNOLOGIES PTE. LTD., Singapore (SG)

(72) Inventors: My T. Nguyen, Tra Vinh (SG); Cuong Q. Hong, Tra Vinh (VN); Luong V. Truong, Tra Vinh Province (VN); Hien H. Nguyen, Hau Giang Province (VN); Brian D. Nguyen, Singapore (SG); Christina M. Nguyen, San Francisco, CA (US)

(73) Assignee: RYNAN TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/592,075

(22) Filed: Oct. 3, 2019

(65) Prior Publication Data

US 2020/0032557 A1 Jan. 30, 2020

Related U.S. Application Data

(62) Division of application No. 15/205,627, filed on Jul. 8, 2016, now Pat. No. 10,458,153.
(Continued)

(51) Int. Cl.
*E05B 67/10* (2006.01)
*G07C 9/00* (2020.01)
(Continued)

(52) U.S. Cl.
CPC ..... *E05B 67/10* (2013.01); *G07C 9/00563* (2013.01); *G07C 9/00944* (2013.01);
(Continued)

(58) Field of Classification Search
CPC .... E05B 67/10; E05B 39/005; E05B 47/0003; E05B 47/0012; E05B 2047/0058; G07C 9/00563; G07C 9/00944; G08C 17/02
(Continued)

(56) References Cited

U.S. PATENT DOCUMENTS 5,592,837 A * 1/1997 McBride ..... E05B 29/0013 70/340
6,046,558 A 4/2000 Larson et al.
(Continued)

FOREIGN PATENT DOCUMENTS

CN 102345422 A 2/2012
CN 103282591 A 9/2013
(Continued)

OTHER PUBLICATIONS

Extended European Search Report dated Jun. 13, 2019, for corresponding EP Application No. 16820610.0, 18 pages.
(Continued)

*Primary Examiner* — Omar Casillashernandez

(57) ABSTRACT

A padlock is disclosed comprising an electronic circuitry and such that the padlock may be opened via a near field communication network such as Bluetooth™ or via other electronic interfaces such as an integrated fingerprint scanner. In one embodiment the padlock is capable of receiving and transmitting radio frequency signals from nearby sensor nodes containing information regarding temperature, humidity, moisture, speed, vibration, liquid level, concentration of gases and other sensing devices for use in a system for monitoring, tracking, tracing, alarms, access management, access recording, authenticity and integrity of goods, documents or other valued objects in storage or transit.

8 Claims, 16 Drawing Sheets

Related U.S. Application Data

(60) Provisional application No. 62/190,466, filed on Jul. 9, 2015.

(51) Int. Cl.
*G08C 17/02* (2006.01)
*E05B 39/00* (2006.01)
*E05B 47/00* (2006.01)

(52) U.S. Cl.
CPC ..... *G08C 17/02* (2013.01); *E05B 39/005* (2013.01); *E05B 47/0003* (2013.01); *E05B 47/0012* (2013.01); *E05B 2047/0058* (2013.01); *E05B 2047/0067* (2013.01); *E05B 2047/0069* (2013.01); *E05B 2047/0095* (2013.01); *G07C 2009/0092* (2013.01); *G07C 2009/00642* (2013.01)

(58) Field of Classification Search
USPC ..... 340/5.73
See application file for complete search history.

(56) References Cited

U.S. PATENT DOCUMENTS 6,442,983 B1 9/2002 Reed
7,021,092 B2 * 4/2006 Loughlin ..... E05B 67/38 70/25
7,140,209 B2 11/2006 Lai
7,225,648 B2 6/2007 Lai
7,411,495 B2 8/2008 Auerbach et al.
7,423,515 B1 * 9/2008 Fiske ..... E05B 47/0002 340/5.2
7,424,812 B2 9/2008 Loughlin
7,628,045 B2 12/2009 Yu
8,154,397 B2 4/2012 Astrin et al.
8,453,481 B2 6/2013 Meekma
8,640,513 B2 2/2014 Goren
8,640,514 B2 2/2014 Goren
8,875,550 B1 11/2014 Spunt
8,912,884 B2 12/2014 Fisher et al.
9,109,379 B1 8/2015 Ranchod
9,472,125 B2 10/2016 Debrody et al.
9,495,820 B1 * 11/2016 Li ..... E05B 37/0068
9,523,218 B1 12/2016 McGraw et al.
9,747,739 B2 8/2017 Gengler et al.
9,996,999 B2 6/2018 Conrad et al.
2003/0179073 A1 9/2003 Ghazarian et al.
2004/0255623 A1 12/2004 Sun et al.
2005/0044906 A1 3/2005 Spielman et al.
2005/0132764 A1 6/2005 Loughlin et al.
2006/0150890 A1 7/2006 Lai
2006/0179903 A1 8/2006 Goldman
2006/0266084 A1 11/2006 Kuo
2006/0283216 A1 12/2006 Marcelle
2008/0012686 A1 1/2008 Bonestroo
2008/0024272 A1 1/2008 Fiske
2008/0250825 A1 * 10/2008 Lai ..... E05B 67/24 70/25
2009/0282876 A1 11/2009 Zuraski et al.
2010/0083713 A1 4/2010 Woodling
2011/0079054 A1 4/2011 Loughlin et al.
2011/0199204 A1 8/2011 Dionis et al.
2012/0011366 A1 1/2012 Denison et al.
2012/0144885 A1 6/2012 Mills
2012/0234062 A1 9/2012 Loughlin et al.
2012/0279264 A1 * 11/2012 Yu ..... E05B 67/06 70/21
2012/0312057 A1 * 12/2012 Tonelli ..... E05B 67/38 70/20
2014/0091931 A1 4/2014 Cova et al.
2014/0150502 A1 * 6/2014 Duncan ..... E05B 67/14 70/20
2014/0250954 A1 * 9/2014 Buzhardt ..... G07C 9/00 70/20
2014/0352370 A1 12/2014 Huang
2016/0058181 A1 3/2016 Han et al.
2016/0163140 A1 6/2016 Lagimodiere et al.

FOREIGN PATENT DOCUMENTS

CN 203201283 U 9/2013
CN 203891610 U 10/2014
CN 204002132 U 12/2014
EP 2454609 B1 3/2014
WO 2010127389 A1 11/2010
WO 2013078561 A1 6/2013
WO 2016192000 A1 12/2016

OTHER PUBLICATIONS

International Search Report issued in corresponding PCT Application No. PCT/CA2016/050798 dated Jun. 13, 2019.

* cited by examiner

PADLOCK

CROSS REFERENCE TO RELATED APPLICATION

This application is a Divisional of U.S. application Ser. No. 15/205,627 filed on Jul. 8, 2016, which itself claims benefit of U.S. provisional application Ser. No. 62/190,466 filed on Jul. 9, 2015. All documents above are incorporated herein in their entirety by reference.

FIELD OF THE INVENTION

The present invention relates to a padlock. In particular, the present invention relates to a padlock and system that can be opened electronically.

BACKGROUND TO THE INVENTION

The prior art discloses a variety of biometric and wireless operational padlocks. US Patent Application 2004/0255623, for example, describes a padlock having a shackle and a body comprising a fingerprint sensor, a fingerprint data memory device and an electromagnetic device activated by a sensed and matched fingerprint to unlock the shackle from the body. US Patent Application 2008/0012686 discloses a padlock comprising an electronic circuit with a fingerprint sensor. The disclosed padlock can be unlocked with a fingerprint or thumbprint. U.S. Pat. No. 8,453,481 discloses an electronic padlock. US Patent Application 2014/0150502 discloses a portable lock including a wireless signal receiver. The lock may be unlocked by transmitting a wireless unlock signal from a portable device such as a cellular telephone. WO2010/127389 discloses an electronic locking system including an electronic lock with locking member and communication device, which can receive and transmit radio frequency signals. The disclosed electronic locking system includes a microprocessor, a solenoid or direct current motor or servo motor, at-least a capacitor, an antenna and a battery. Also, WO2013/078561 describes an electronic lock device and controlling an electronic lock device via communication through a local wireless communication network. US Patent Application 2014/0250954 discloses a padlock which collects, stores, displays, and/or transmits information each time the apparatus is opened, closed, or even merely handled. The functions and performance of the disclosed padlock may be manually or remotely controlled and manipulated. The disclosed apparatus may be also manually or remotely interrogated and the information gathered by the apparatus may be locally stored and/or be transmitted to a remote receiver such as a cell phone or a computing device. Finally, European Patent 2454609 discloses an electronic security seal or "eSeal" system, which can monitor the authenticity and integrity of shipped goods in intermodal containers, report tampers in real-time, monitor environmental status of the goods and report exceptions in real-time, and report the location of the shipment with sufficient frequency to allow management of supply chain exception events.

SUMMARY OF THE INVENTION

There is provided a padlock comprising a metal body, metal shackle and locking mechanism, which can be unlocked electronically by an authorized fingerprint and/or by receiving a radio frequency unlock signal from a mobile device such as a smartphone, tablet, or personal computer.

More specifically, this invention relates to padlocks further comprising electronic circuits in the padlock's body, which are capable of receiving radio frequency signals from nearby sensor nodes containing information regarding temperature, humidity, moisture, speed, vibration, liquid level, concentration of gases and other sensing devices. The comprised electronic circuits are also capable of transmitting in real time the received information and Global Positioning System (GPS) coordinates in the form of radio frequency signals via wireless communication to the Internet for monitoring, tracking, tracing, alarms, access management, access recording, authenticity and integrity of goods, documents or other valued objects in storage or transit. Optionally, the received and transmitted information can be stored in the memory for later processing and use.

The invention is further related to the use of padlocks for security, travelling, transportation and supply chain logistics. The padlocks may also be used as an electronic seal, or eSeal, which can be applied on physical goods in order to provide a guarantee of important aspects of the protection of those physical goods. In this regard, the eSeal does not only physically protect the sealed goods but can also provide propositions and evidence of authenticity and integrity.

In particular, there is disclosed a padlock comprising a shackle comprising a heel end pivotally attached to a padlock body for rotation about a first axis perpendicular to a plane and a toe end opposite the heel end and moveable in the plane between a first position wherein the toe end is away from the body, and a second position wherein the toe end is received within a detent in the body, a detent mechanism comprising a stop and an actuator for moving the stop in a direction parallel to the axis between a locked position wherein the stop engages the toe end securing the toe end within the detent and an unlocked position wherein the stop no longer engages the toe end, an electronic circuit comprising at least one user input for controlling the actuator such that the stop is moved between the locked position and the unlocked position, and a battery for powering the electronic circuit and the actuator.

There is also disclosed a system for securing a load in a closed storage compartment, the compartment comprising a door comprising a latching mechanism actuated from outside the storage compartment. The system comprises a wireless communication network, at least one sensor node for placement within the storage compartment, the sensor node comprising a nearfield module and at least one sensor for detecting a condition selected from a group comprising temperature, humidity, moisture, speed, vibration, liquid level, gas concentration and combinations thereof, a padlock for securing the door latch mechanism. The padlock comprises electronics comprising a near field interface for communicating with the at least one sensor node, and a wireless interface for receiving and transmitting in real-time the detected condition to the user via the communication network, and a locking mechanism actuatable electronically by at least one of an authorized fingerprint, an unlock signal received via the nearfield interface and an unlock signal received from the wireless communication network via the wireless interface.

Also disclosed is a method for securing an item of luggage suitable for locking with a padlock. The method comprises attaching a padlock to the luggage to be locked, the padlock comprising electronics comprising a near field interface, and a locking mechanism actuatable electronically by an unlock signal received via the nearfield communication network, establishing a communication link between a smartphone executing a padlock control application and the nearfield interface using a near field network, and locking the luggage using the padlock by the padlock control application issuing a locking command.

DETAILED DESCRIPTION OF THE ILLUSTRATIVE EMBODIMENTS

Figure 1B:
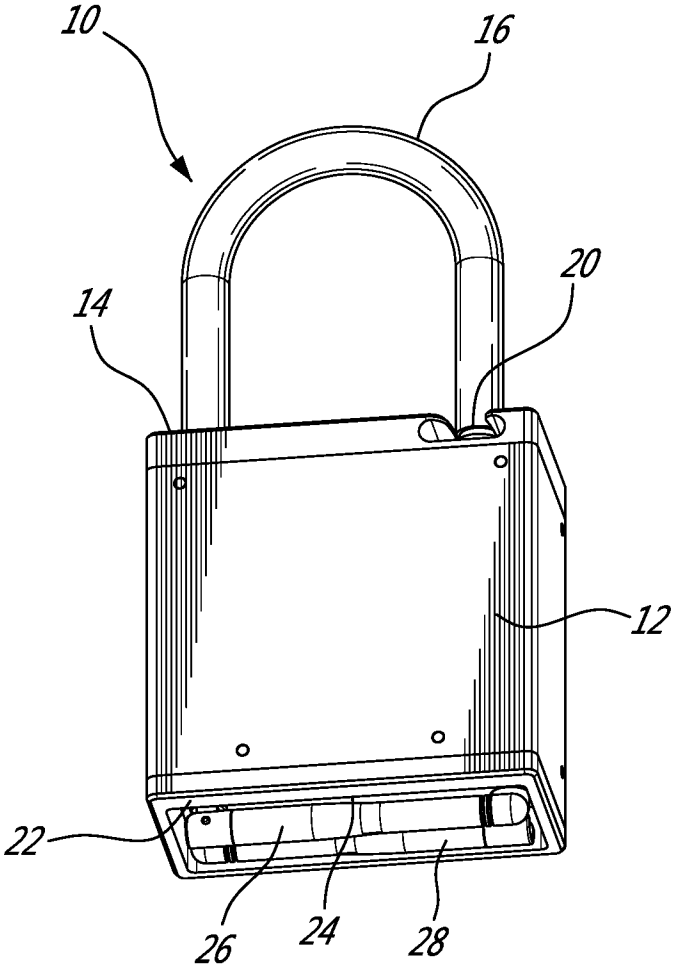
FIGS. 1A and 1B provide respectively raised right front and lowered right rear perspective views of a padlock in accordance with a first illustrative embodiment of the present invention.
Figure 1A:
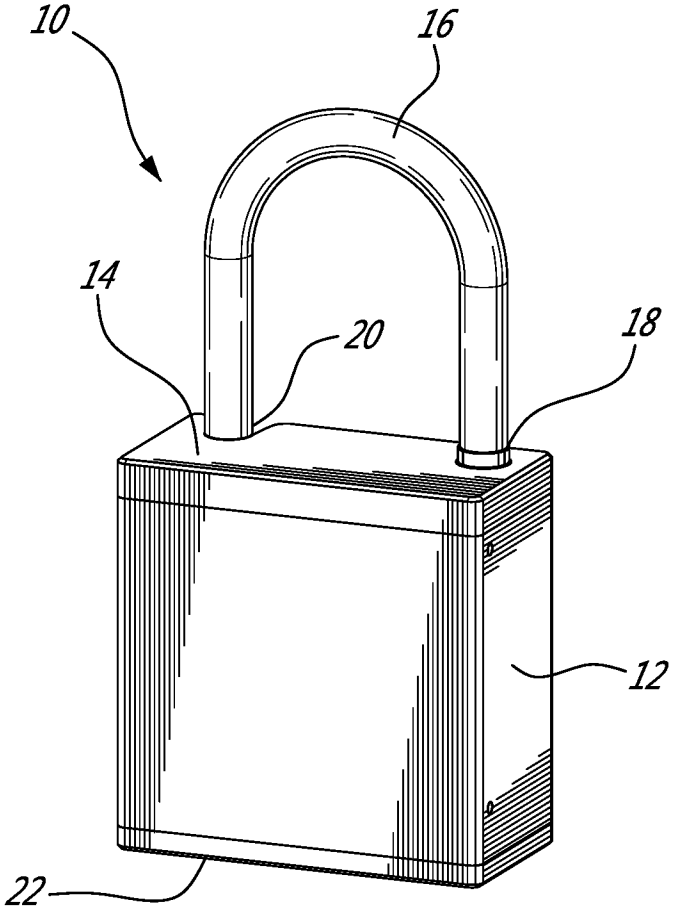

Referring now to FIGS. 1A and 1B, a padlock in accordance with a first illustrative embodiment of the present invention, and generally referred to using the reference numeral 10, will now be described. The padlock 10, which is typically manufactured from a hard rugged material such as metal, comprises a housing body 12, a housing top 14, a U-shaped stainless steel shackle 16 comprising a shackle heel 18 and a shackle toe 20. In a particular embodiment, and as will be discussed in more detail below, a fingerprint sensor (not shown) may also be provided. The padlock 10 additionally comprises a bottom 22, a battery recharging port 24 such as a USB compatible receptacle, for example in the form of a USB Mini-B compatible receptacle or the like, a first antenna 26, such as a GSM reception and transmission, and a second antenna 28, such as an antenna suitable for GPS reception.

Figure 2A:
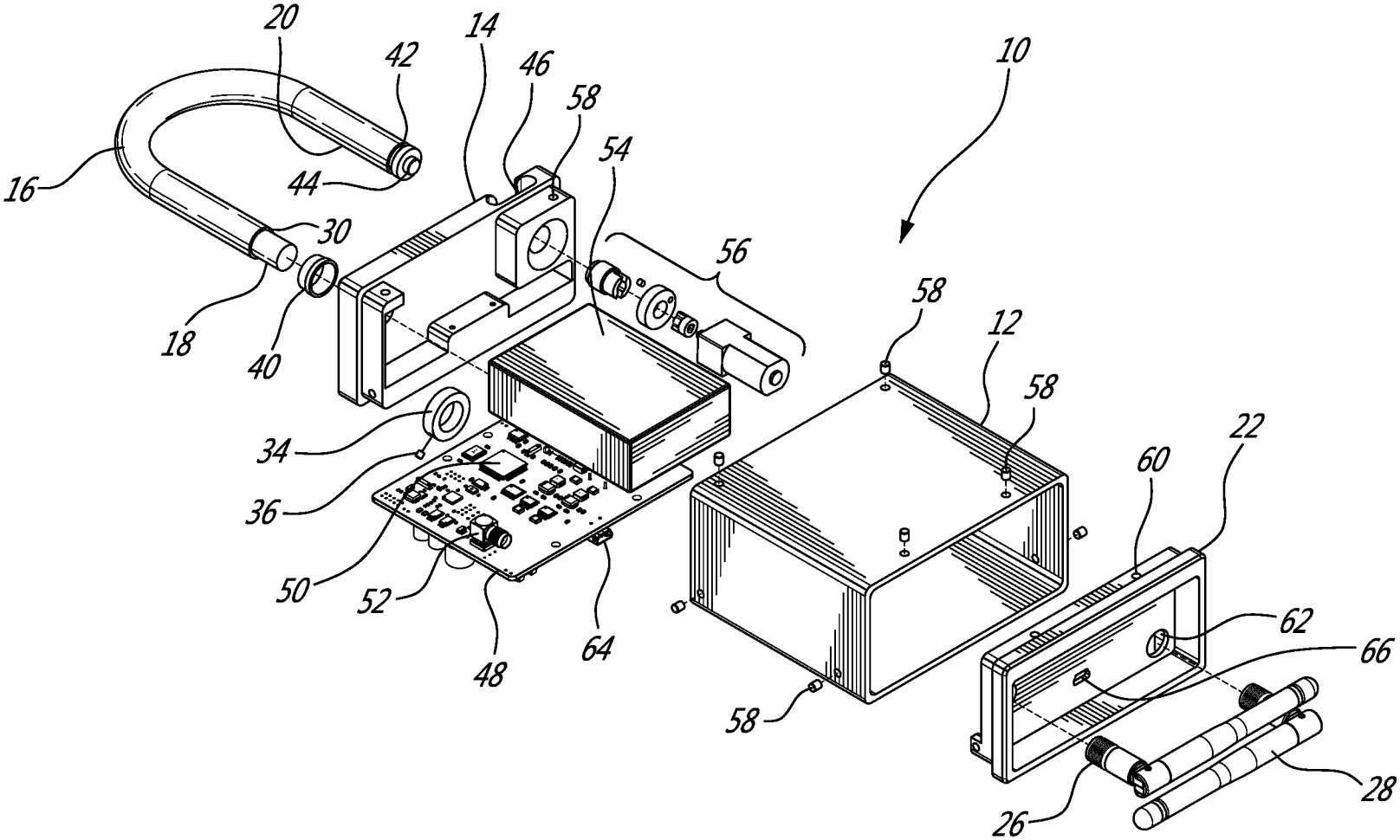
FIGS. 2A and 2B provide respectively bottom and top exploded views of a padlock in accordance with a first embodiment of the present invention.
Figure 2B:
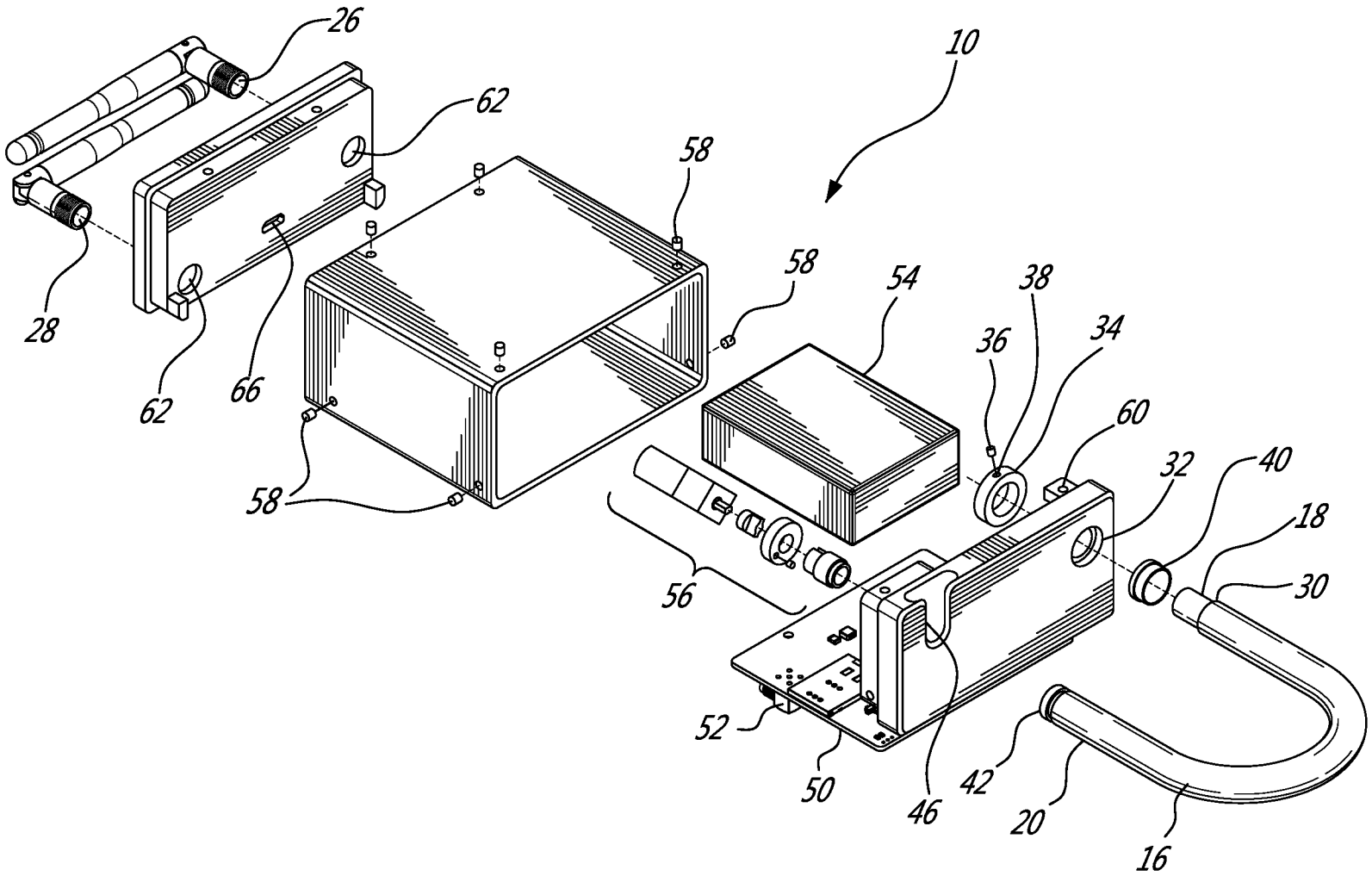

Referring now to FIGS. 2A and 2B, in a first embodiment the padlock 10, the shackle heel 18 is of a diameter less than that of the shackle 16 and such that a ledge 30 is formed. On assembly the shackle heel 18 is inserted into a bore 32 formed in the housing top 14 until the ledge 30 butts against the housing top 14. The shackle 16 is then rotatably secured in this position using a collar 34. In this regard the collar 34 comprises a set screw or pin 36 which is received in a complementary bore 38 in the collar 34 which engages the end of the shackle heel 18. In order reduce the ingress of water and the like into the padlock 10, a bushing seal 40 is inserted into the bore 32 and rests about the shackle heel 18. As will be discussed in more detail below, the toe end 20 of the shackle 14 comprises a groove 42. Additionally, a pin 44 extends from the toe end 20. The toe end 20 of the shackle 14 is releasable securable within a shackle detent 46 formed in the housing top 14. In this regard the detent 46 is open sided and such that the toe end 20 of the shackle 14 may be swung into the detent 46 as the shackle 14 is rotated about its rotatably secured shackle heel 18.

Still referring to FIGS. 2A and 2B, the padlock 10 further comprises a printed circuit board (PCB) 48 on which electronics 50 are soldered as well as antenna jacks 52, a rechargeable battery 54 and a locking mechanism 56. The PCB 48, battery 54 and locking mechanism 56 are retained within the housing body 12 by the housing top 14 and housing bottom 22 which act as end caps sealing the housing body 12. The housing top 14 and housing bottom 22 are secured to the housing body 12 using fasteners 58 such as rivets or pins or the like which engage with complementary bores or indents 60 in either the housing top 14 or housing bottom 22. On assembly the threaded antenna jacks 52 are accessible from outside of the padlock 10 via apertures 62 which are provided in the housing bottom 22 and onto which the first and second antennas 26, 28 can be secured. Additionally, the recharging port 24 and illustratively comprising a USB Mini-B type plug 64 is externally accessible via a plug aperture 66 also in the housing bottom 22.

Figure 3B:
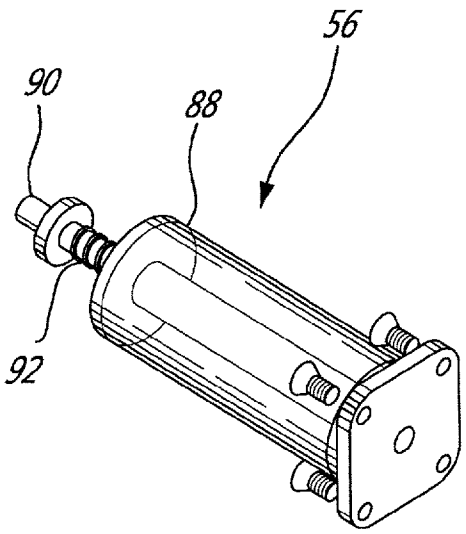
FIG. 3B provides a detailed view of a lock securing and releasing assembly and in accordance with an alternative embodiment of the present invention.
Figure 3A:
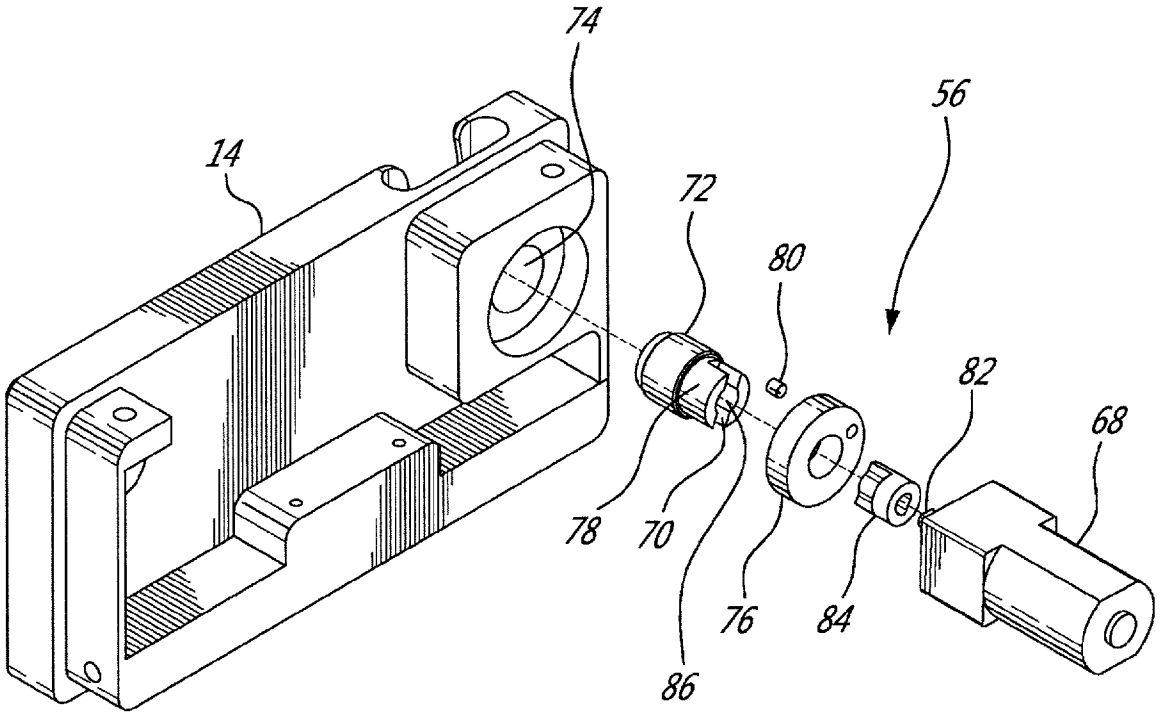
FIG. 3A provides an exploded detailed view of a lock securing and releasing assembly and in accordance with a first embodiment of the present invention.

Referring now to FIG. 3A, in a first embodiment the locking mechanism 56 comprises a battery driven DC stepper motor 68 which moves a stop 70, illustratively in the form of a locking cylinder which is rotatably mounted via a threaded outer surface 72 within a complementary threaded bore 74 in the housing top 14 and which is moved by rotation. The locking cylinder 70 is prevented from being withdrawn from the threaded bore 74 by a collar 76 which is mounted to an unthreaded end 78, for example using a pin or set screw 80 or the like. An end of a shaft 82 of the motor 68 is of an illustratively u-shaped cross section and mounted to a paddle 84 which rotates with the shaft 82. The paddle 84 rests slideably within a slot 86 formed in the unthreaded end of the locking cylinder 70 and such that as the paddle 84 rotates with the shaft 82 the locking cylinder 70 will also rotate within the threaded bore 74 and such that the locking cylinder 70 moves along the length of the threaded bore 74 in accordance with the direction and speed of rotation of the shaft 82 and the pitch of the threaded bore 74/threaded outer surface 72.

Referring to FIG. 3B, in an alternative embodiment the lock mechanism 56 can be modified to include a solenoid 88 which moves the stop, illustratively a locking pin 90, axially against the bias of a spring 92 and between a normally locked position and an unlocked position. In this regard, in order to secure the toe end 20 within the detent 46, the locking pin 90 is inserted in a complementary axial bore (not shown) formed in the toe end 20 of the shackle 14.

Figure 4B:
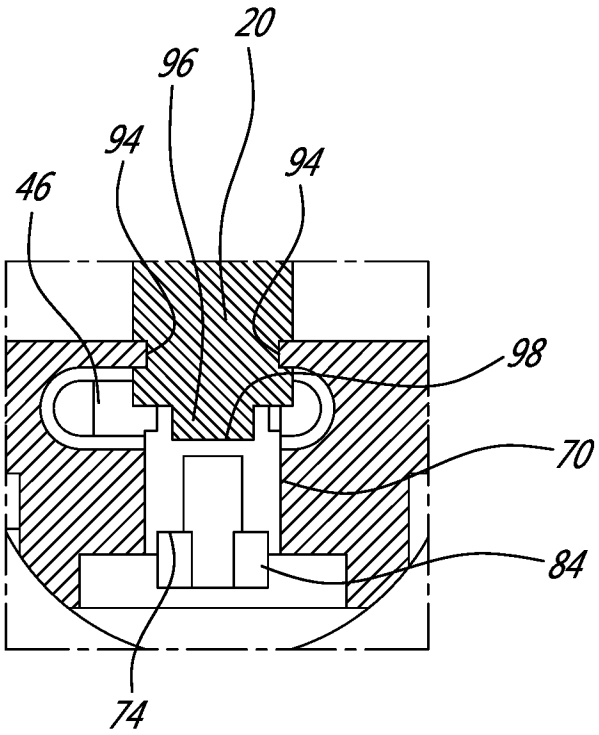
FIGS. 4A and 4B provide respectively a side plan view of a padlock in a closed positon and detailed cutaway view of portion A in FIG. 4A.
Figure 4A:
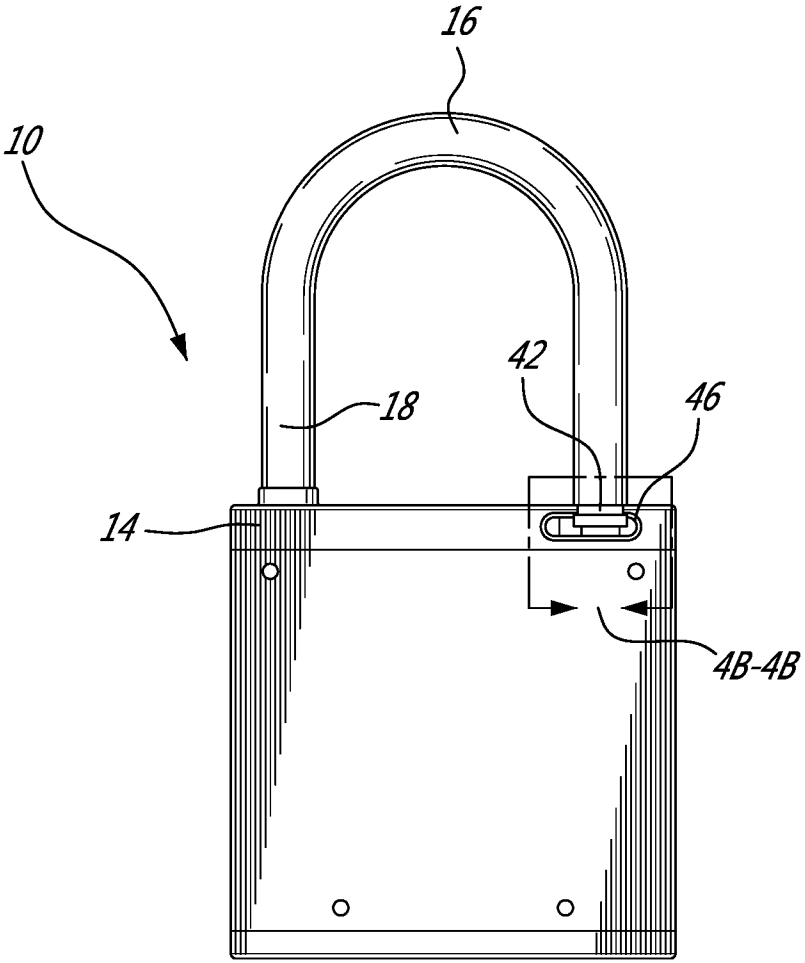

Referring now to FIGS. 4A and 4B in addition to FIG. 3A, as discussed above the housing top 14 comprises an open sided detent 46 such that the toe end 20 of the shackle 16 may be swung into the detent 46 as the shackle 14 is rotated about its rotatably secured shackle heel 18. The detent 46 comprises a curved ridge 94 which engages the groove 42 formed in the toe end 20 thereby preventing the toe end 20 from being pulled axially away from the detent 46. In order to additionally prevent the toe end 20 from moving laterally out of the detent 46, once the toe end 20 is swung into position in the detent 46 the motor 68 is activated thereby rotating the shaft 82, paddle 84 and locking cylinder 70 within the threaded bore 74. As will now be understood by a person of ordinary skill in the art, this causes the locking cylinder 70 to move relative to the toe end 20 as it is rotated within the threaded bore 74. As the locking cylinder 70 moves towards the toe end 20, a tip 96 of the toe end 20 is received within a cup like hollow 98 in the locking cylinder 70, and such that the toe end 20 is prevented from being moved laterally out of the detent 46. The padlock 10 is now secured in a locked position.

Figure 5B:
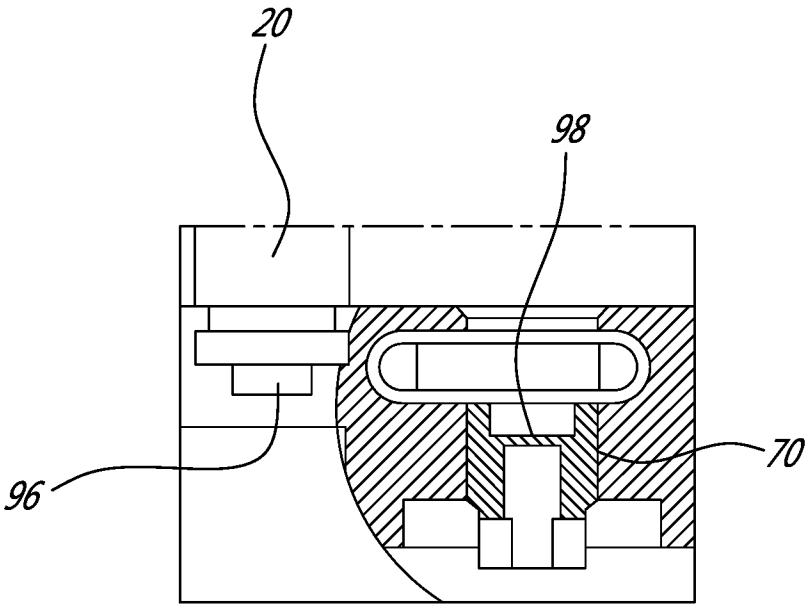
FIGS. 5A and 5B provide respectively a side plan view of a padlock in an open position and detailed cutaway view of portion B in FIG. 5A.
Figure 5A:
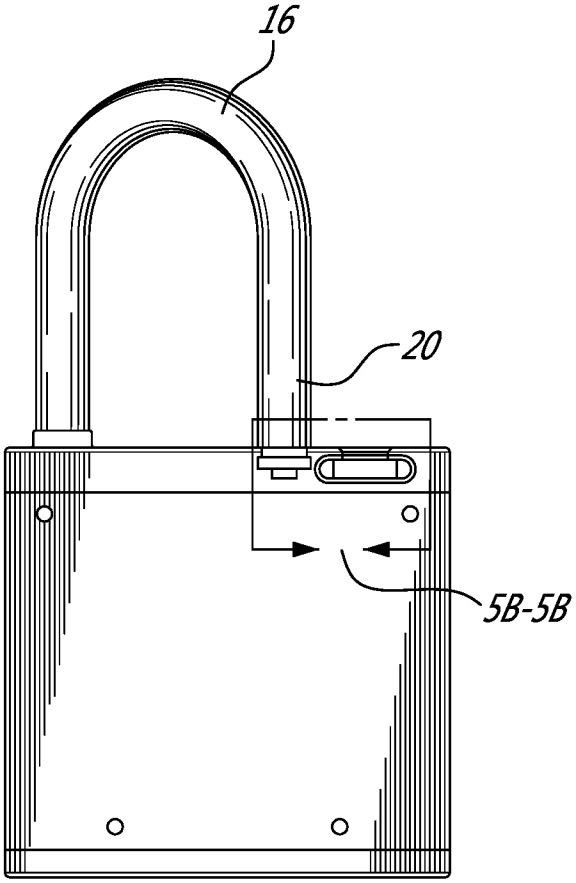

Referring now to FIGS. 5A and 5B in addition to FIG. 3A, unlocking the padlock 10 can be affected by reversing the direction of rotation of the stepper motor 68, thereby causing the locking cylinder 70 to move axially away from the tip 96 of the toe end 20 and such that the tip 96 is no longer retained by the cup like hollow 98 in the locking cylinder 70. This allows the toe end 20 to swing freely out of the detent 46. The padlock 10 is now unlocked.

Figure 6:
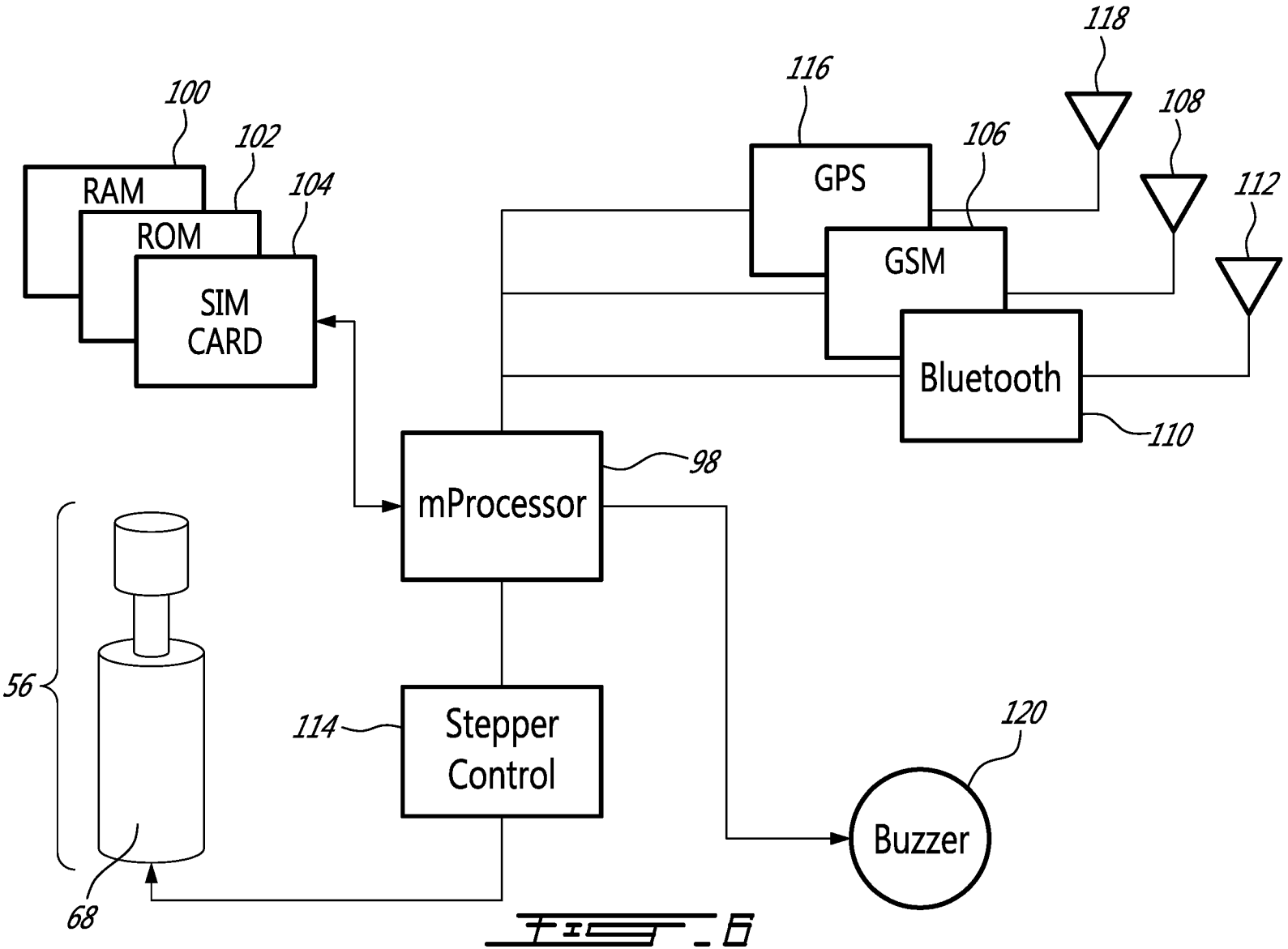
FIG. 6 provides a schematic diagram of an electronics for use in a padlock and and in accordance with an illustrative embodiment of the present invention.

Referring now to FIG. 6 in addition to FIG. 2A, the electronics 50 on the PCB 48 comprise a microprocessor 98 which, using programs and/or data stored in memory such as a RAM 100, ROM 102 or SD Data Card 104 as well as commands received by one of a GSM/GPRS interface 106 and associated antenna 108 or a Bluetooth™ interface 110 and associated antenna 112, controls the stepper motor 68 of the lock securing and releasing assembly 56 via a stepper control 114 such that the padlock 10 is one of a locked position or unlocked. In a first embodiment the electronics 50 may also comprise a GPS module 116 and associated antenna 118 for providing a current location of the padlock 10 as well as an audible alarm such as a buzzer 120 or the like. The current position and status of the padlock 10 can be stored from time to time together with a time stamp and the like in memory and such that it can be retrieved later for examination and analysis.

Still referring to FIG. 6, in this manner the padlock 10 is able to receive, for example, radio frequency signals from nearby devices transmitting between 2.4 and 2.6 GHz and using Bluetooth™ communication according to the IEEE 802.15.1 standard. Signals received via the Bluetooth™ interface 110 may then be converted by the microprocessor 98 and programs and/or data stored in RAM 100, ROM 102, or on a SIM Card 104, for example, to data and stored in the memory chip for subsequent retrieval using an external device such as a smart phone, tablet, or the like. For example, the data may be retransmitted via radio frequency signals at 850, 900, 1800 and/or 1900 MHz and the GSM/GPRS module 106, and subsequently to the Internet via wireless communication or the like (both not shown).

Figure 7B:
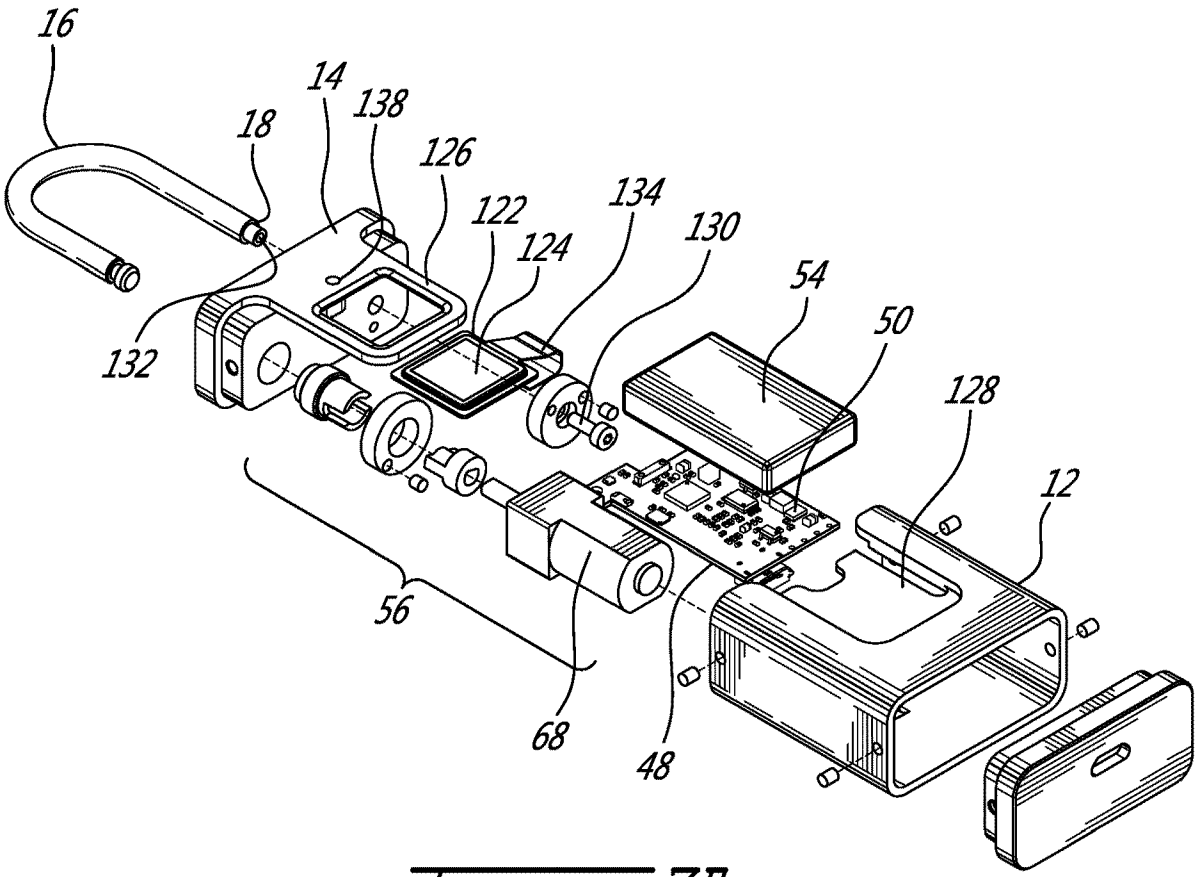
FIGS. 7A and 7B provide respectively a right front and an exploded view of a padlock in accordance with a first alternative illustrative embodiment of the present invention.
Figure 7A:
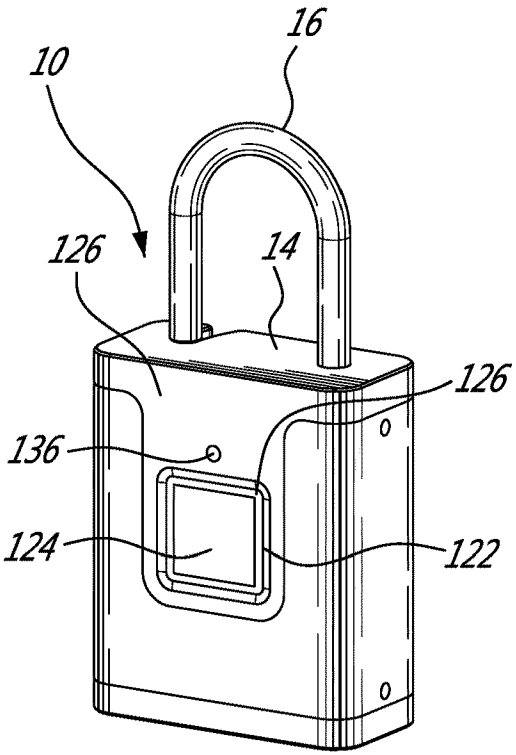

Referring now to FIGS. 7A and 7B, in a first alternative embodiment the padlock 10 comprises a capacitive fingerprint scanning module 122. As known in the art, capacitive fingerprint scanners use arrays capacitor circuits (not shown) to collect data about a fingerprint. As capacitors can store electrical charge, connecting them up to conductive plates (also not shown) on the scanning surface 124 of the scanner allows them to be used to track the details of a fingerprint. The charge stored in the capacitor changes slightly when a finger's ridge is placed over the conductive plates, while an air gap will leave the charge at the capacitor relatively unchanged. The electronics 50 track these changes, which can then be recorded for example via an analogue-to-digital converter (also not shown) and transferred to the electronics 50 via flexible ribbon cable 134 or the like. The housing top 14 is modified in this embodiment to provide a frame 126 for receiving the scanning surface 124 which requires provision of a complementary cut away portion 128 in the housing 12. The other components such as the stepper motor 68, the lock securing and releasing assembly 56 and the battery remain essentially the same. In the particular embodiment as shown, the heel 18 of the shackle 16 is secured to the housing top 14 using a bolt 130 which is received within a threaded bore 132 in the heel 18. A multicolored LED 136 is also provided to indicate status of the padlock 10 and which is mounted in an aperture 138 in the frame 126. Illustratively, the LED 136 illuminated flashing red indicates the lock is secured, flashing green indicates the lock is open and flashing yellow indicates the rechargeable battery 54 is below 50% of charge.

Figure 8B:
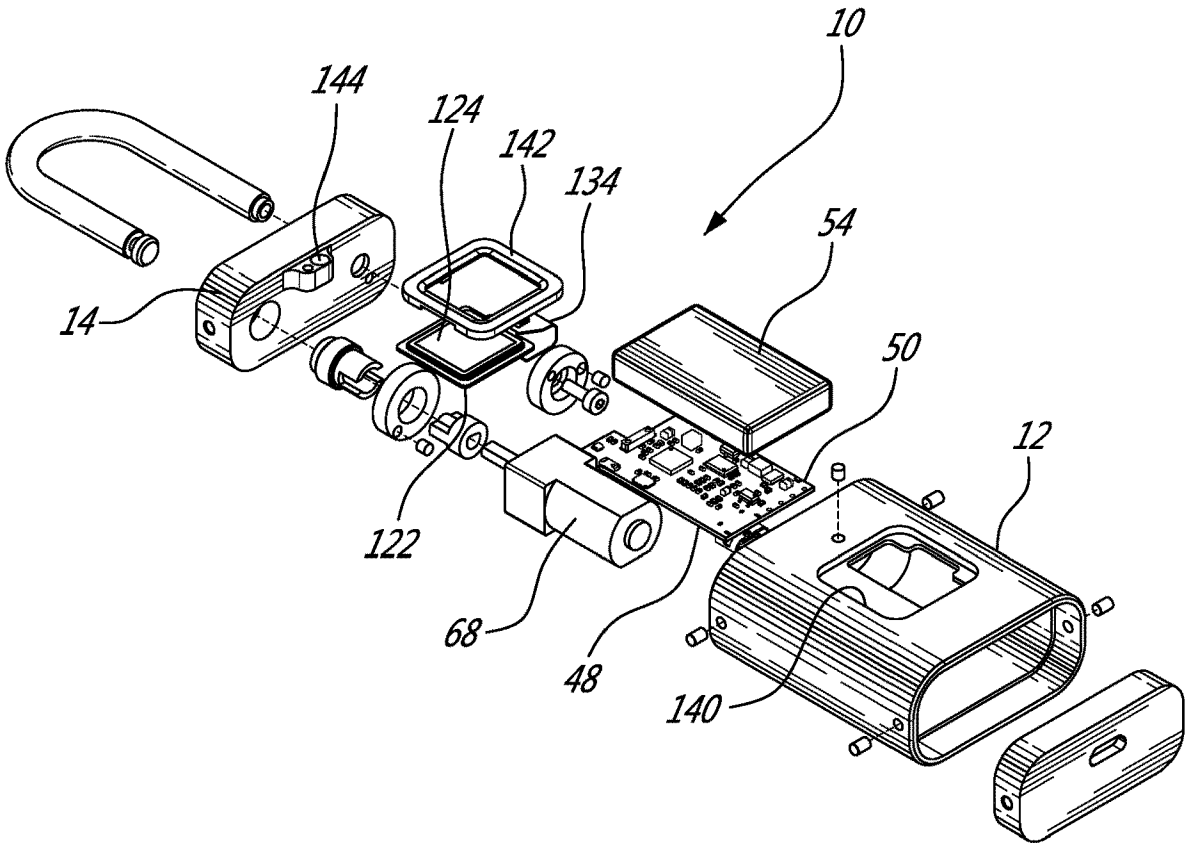
FIGS. 8A and 8B provide respectively a right front and an exploded view of a padlock in accordance with a second alternative illustrative embodiment of the present invention.
Figure 8A:
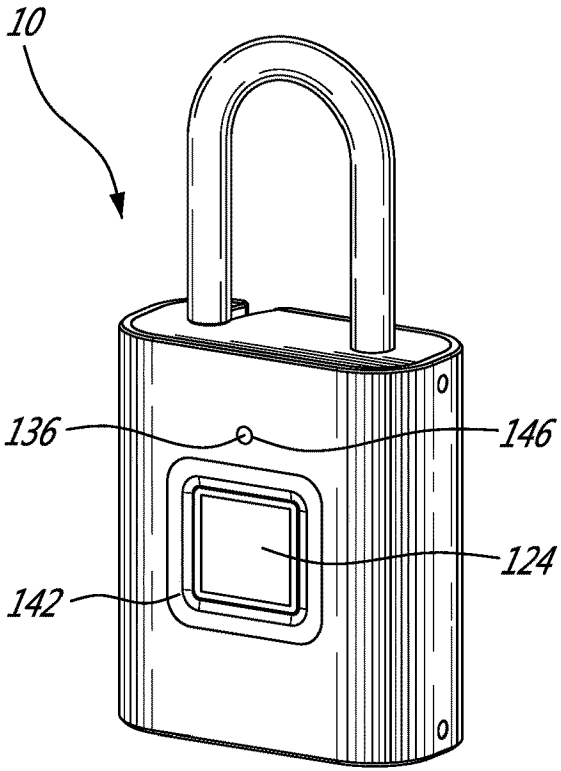

Referring now to FIGS. 8A and 8B, in a second alternative embodiment of the present invention the housing 12 comprises a cutout 140 for receiving a frame 142 which in turn receives the scanning surface 124 of the fingerprint scanning module 122. The scanning module 122 is interconnected with the electronics 50 on the PCB 48 via a ribbon cable 134. The LED 136 is mounted to a receptacle 144 on the housing top 14 and such that on assembly it is aligned with an aperture 146 in the housing 12. Other elements, such as the stepper motor 68 and rechargeable battery 54 and the like are essentially the same as those of the first alternative embodiment.

Figure 9:
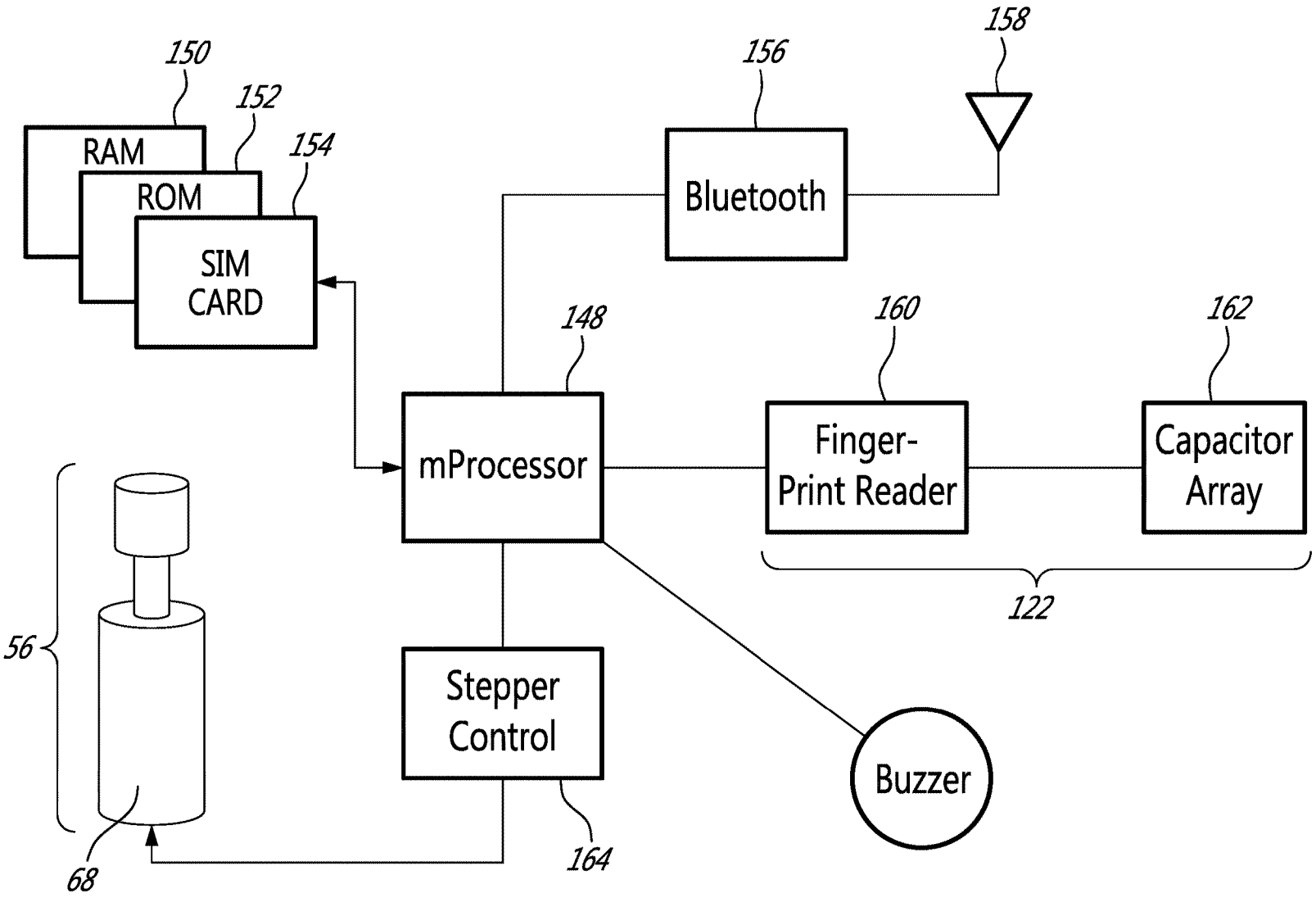
FIG. 9 provides a schematic diagram of an electronics for use in a padlock and and in accordance with an alternative illustrative embodiment of the present invention.

Referring to FIG. 9 in addition to FIGS. 7A and 7B and/or FIGS. 8A and 8B, in the first and second alternative embodiments the electronics 50 on the PCB 48 comprise a microprocessor 148 which, using programs and/or data stored in memory such as a RAM 150, ROM 152 or SD Data Card 154 as well as commands received a Bluetooth™ interface 156 and associated antenna 158 and the capacitive finger print scanning module 122 comprising a finger print reader 160 and associated capacitor array 162, controls the stepper motor 68 of the lock securing and releasing assembly 56 via a stepper control 164 such that the padlock 10 is one of a locked position or unlocked.

Figure 10B:
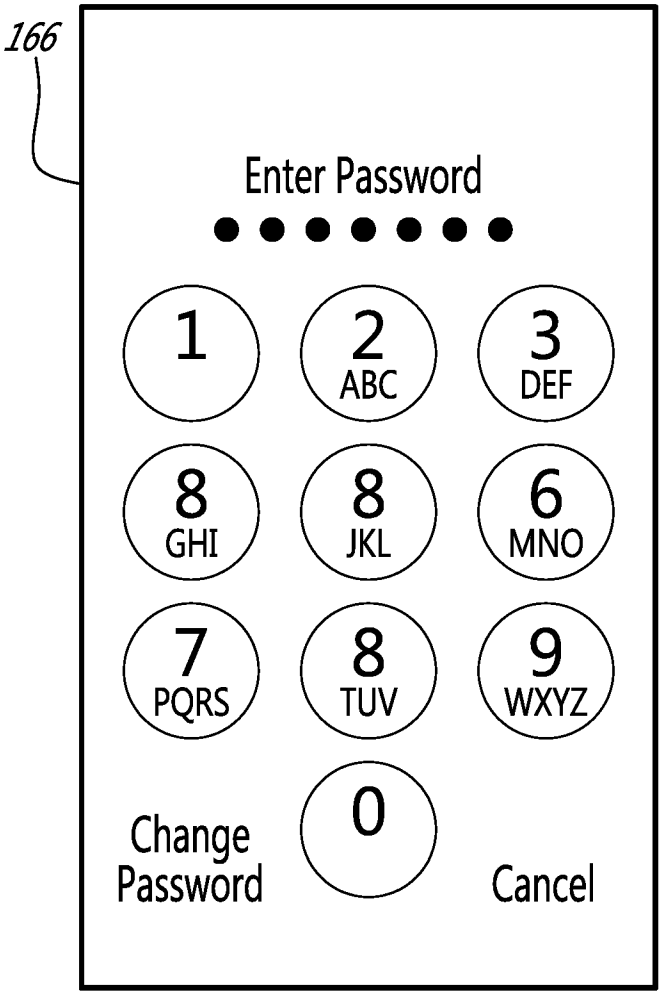
FIGS. 10A though 10H provide screen grabs of an application for interacting with a padlock in order to record fingerprints and in accordance with an illustrative embodiment of the present invention.
Figure 10A:
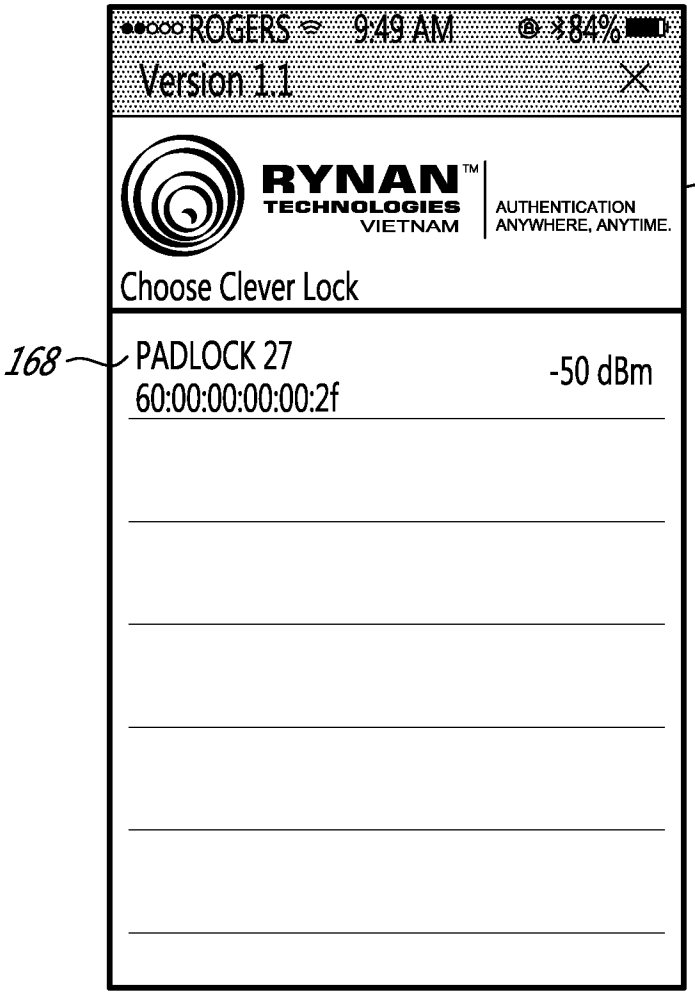
Figure 10C:
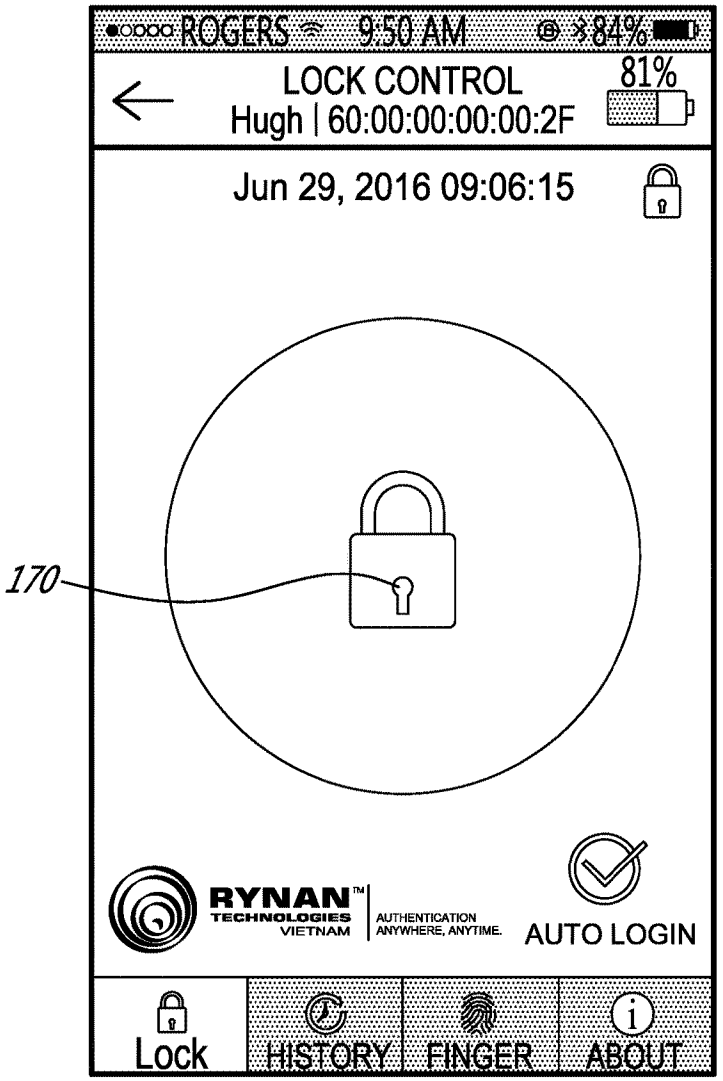
Figure 10D:
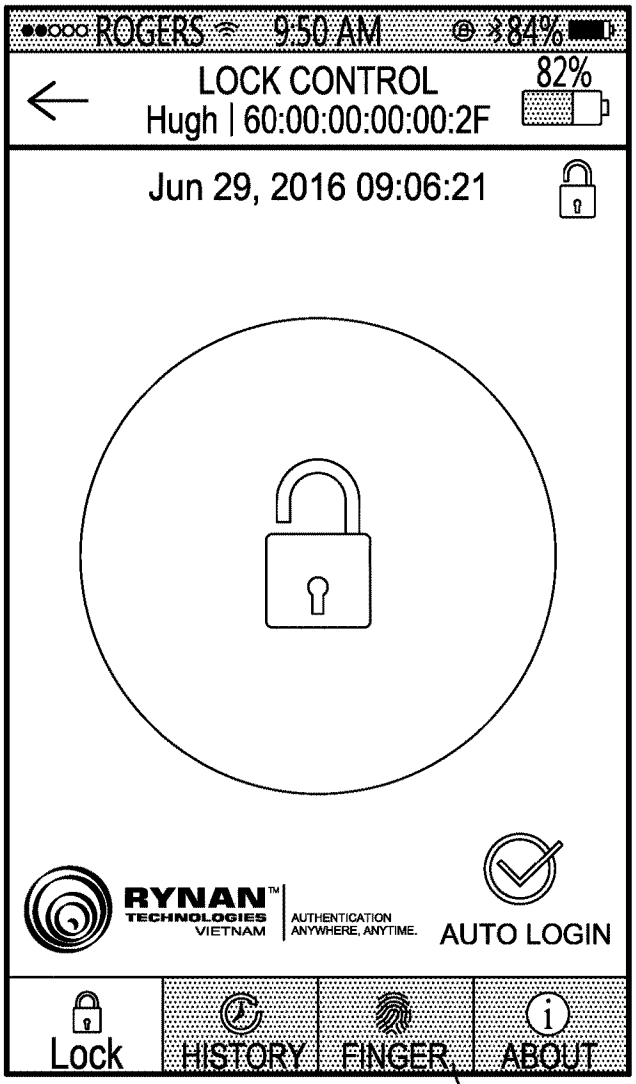
Figure 10F:
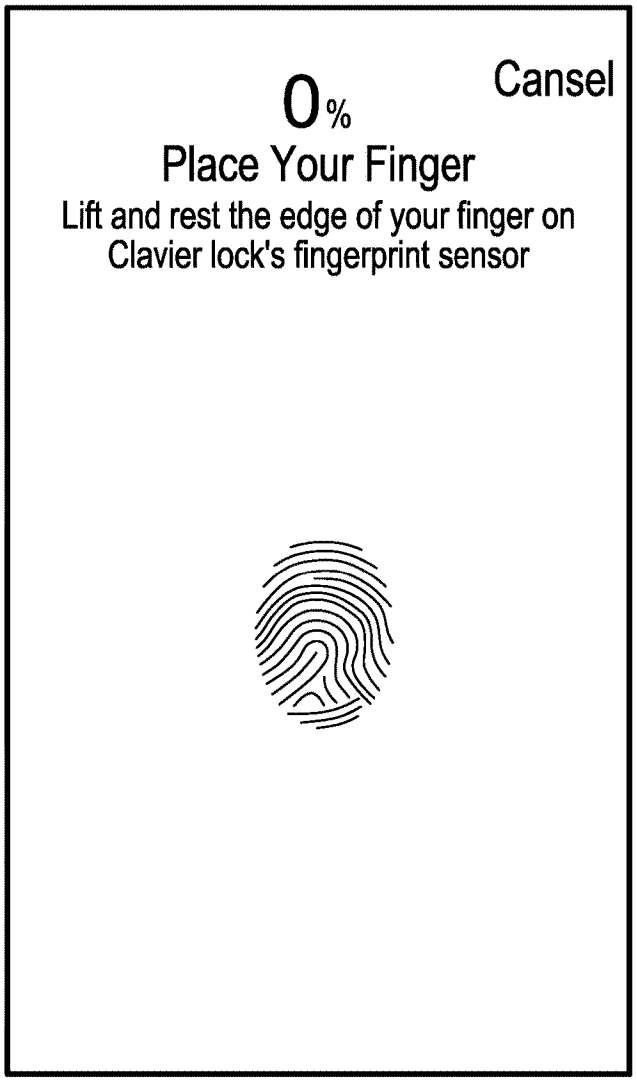
Figure 10E:
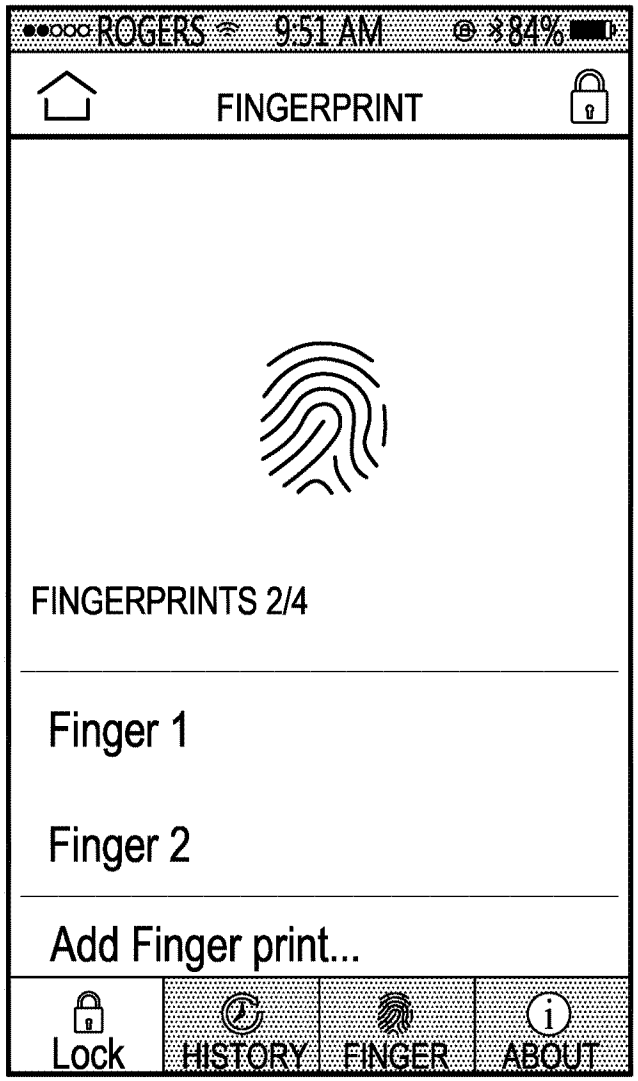
Figure 10G:
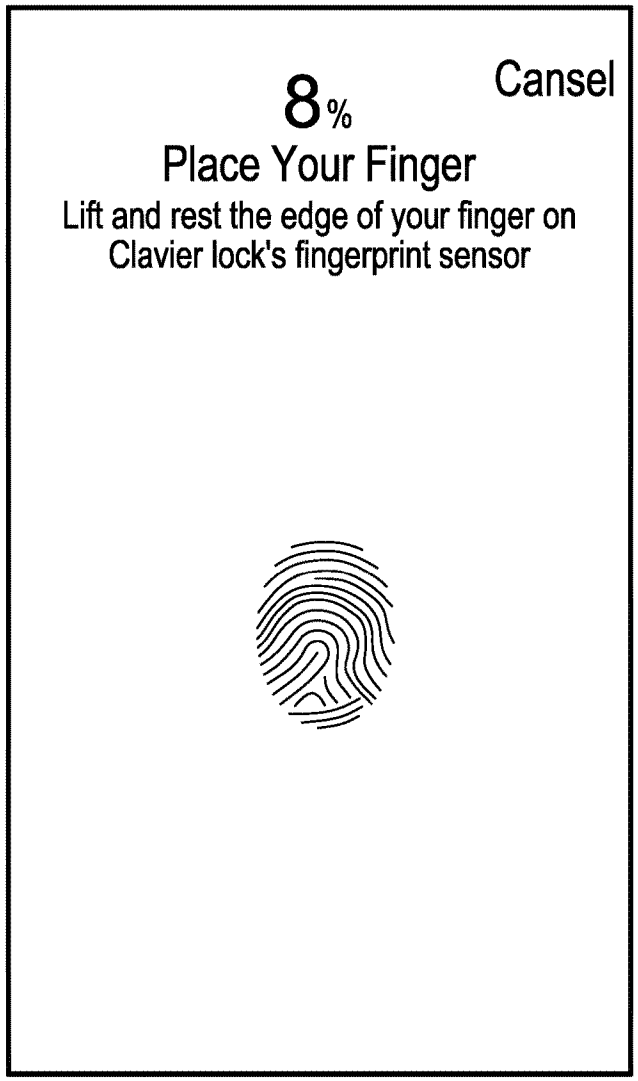
Figure 10H:
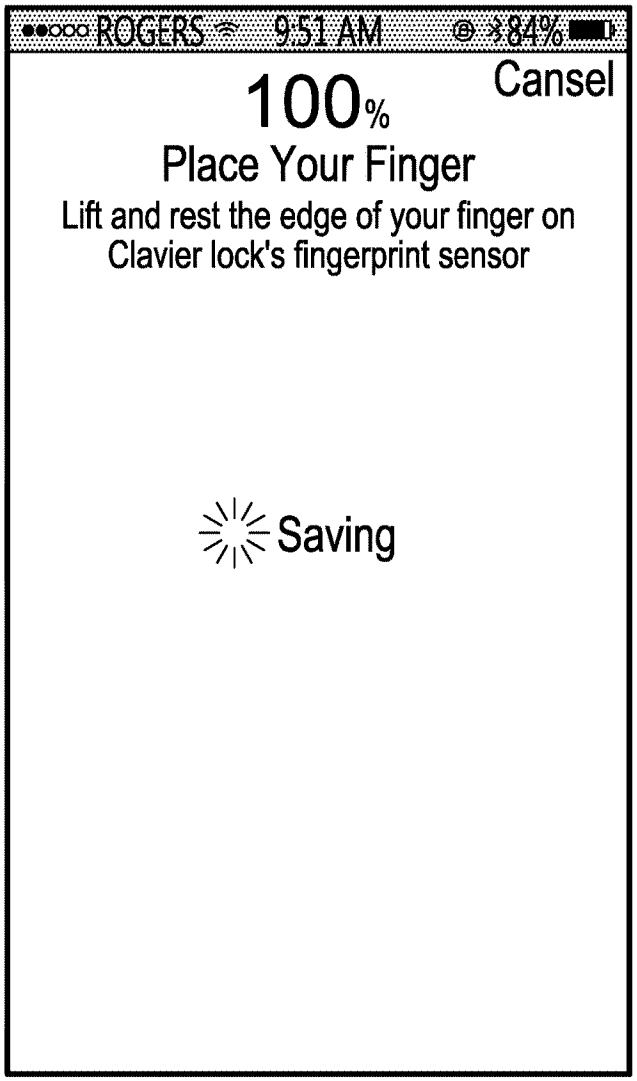

Referring now to FIGS. 10A through 10H, in order to record finger prints such that the padlock can subsequently be opened by a particular user an application is provided. The application is installable on a smartphone or tablet, for example an iOS or Android compatible smartphone (not shown), which can communicate with the padlock 10 via a near field network such as the Bluetooth™ interface. Referring to FIG. 10A on opening the application all padlocks 10 within range are displayed on the display 166 and include such information as padlock name 168 and Media Access Control (MAC) address. Referring to FIG. 10B in order to access a selected one of the padlocks 10 a password such as a Personal Identification Number (PIN) must be correctly input. Referring to FIGS. 10C and 10D once the correct PIN or password has been entered the user is presented with an unlock screen. The selected padlock 10 can be unlocked by tapping on the lock icon 170. Once unlocked new fingerprints can be recorded and recorded fingerprints deleted by tapping the FINGER icon 172. Referring now to FIG. 10E in order to record a new finger print the user taps on "Add Fingerprint . . . ". Referring now to FIGS. 10F through 10H, once the user has selected to add a finger print he is prompted to place his finger on the capacitive finger print scanning module (reference 122 in FIGS. 7A and 8A). The user must typically replace the tip of the finger being scanned a number of times until scanning the fingertip is complete. Once scanning is complete the fingerprint is stored in memory on the padlock 10 and may be used subsequently to unlock and lock the padlock. A multiple of fingerprints may be scanned, including one or more fingerprints of different users.

Figure 11:
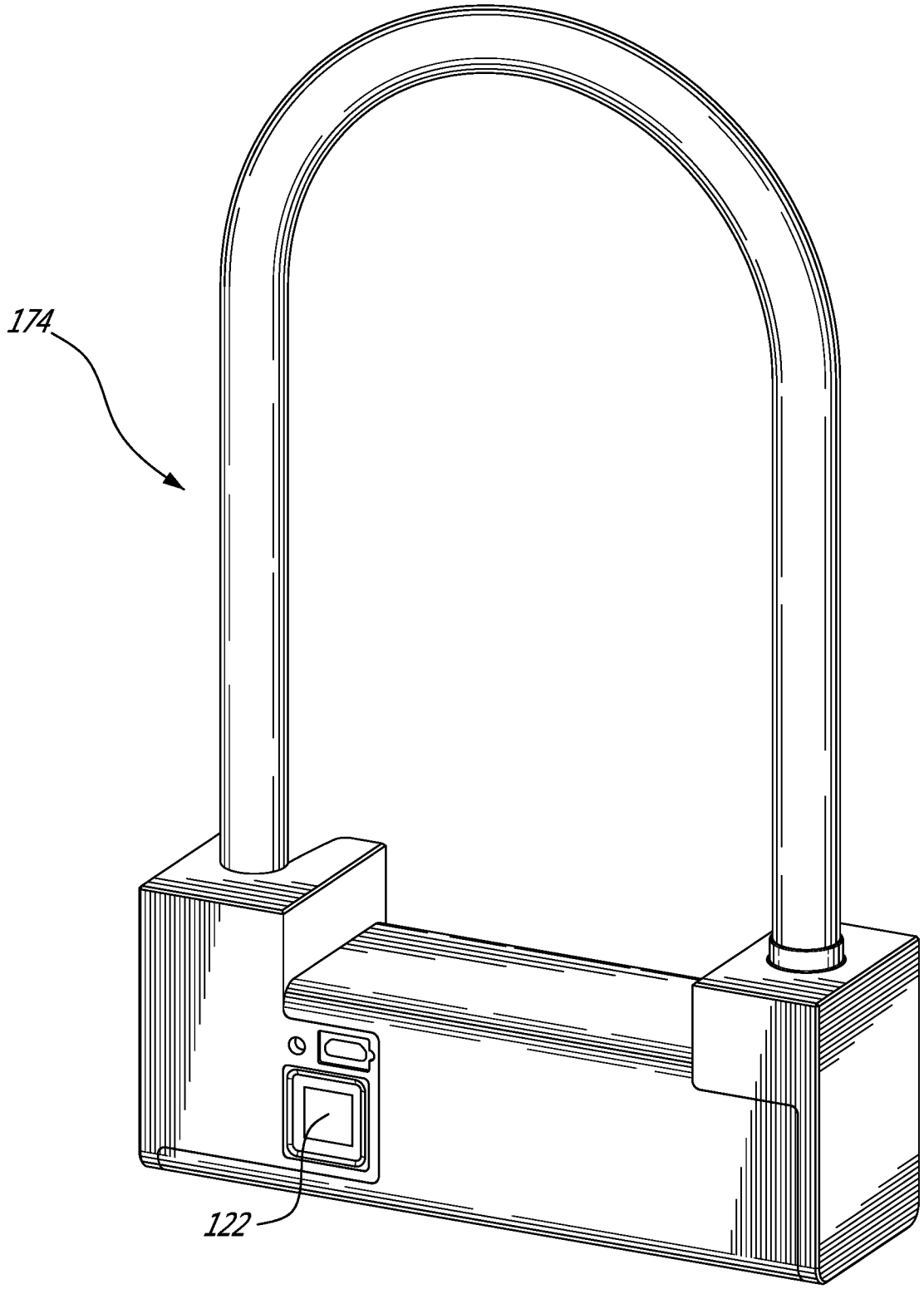
FIG. 11 provides a right front view of a bicycle padlock in accordance with a third alternative illustrative embodiment of the present invention.

Referring now to FIG. 11, in a third alternative embodiment the padlock can be in the form of a large U-shaped lock 174 suitable for use in securing a bicycle or the like (not shown). In this regard the padlock works in essentially the same manner as that of the first and second alternative embodiments in that the padlock 174 can be opened either via a command transmitted via Bluetooth™ or using the fingerprint reader 122.

Figure 12:
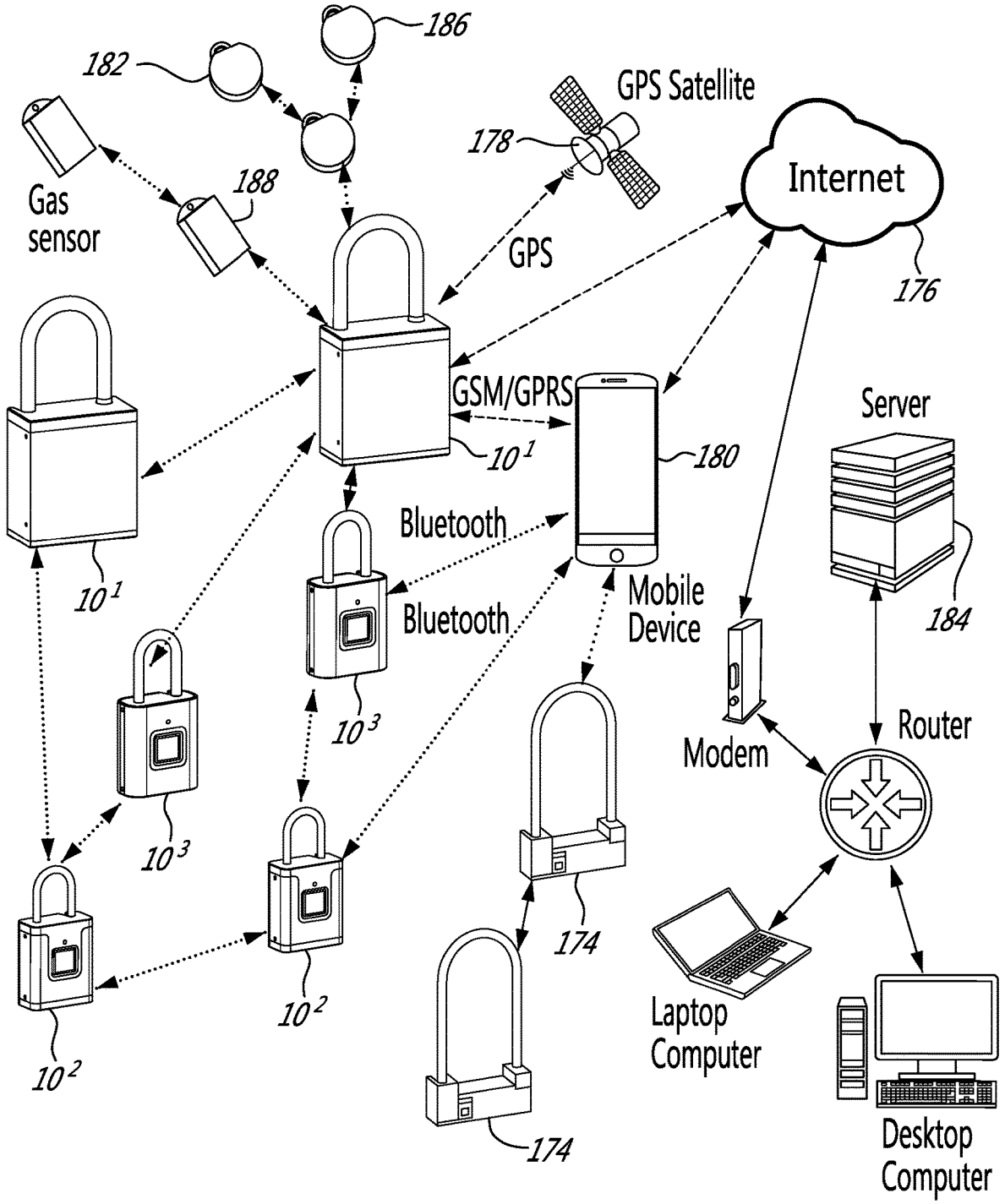
FIG. 12 provides a schematic diagram of a system comprising the padlocks of the present invention.

Referring now to FIG. 12, a communication network taking advantage of the padlocks 10 will now be described. The dotted arrows represent the Bluetooth™ nearfield mesh communication network. The dash and dotted arrows represent wireless communication via GSM/GPRS and GPS. The solid arrows represent communication via a fixed ground network such as DSL or cable or the like. Each of the padlocks $\mathbf{10}^1$, $\mathbf{10}^2$, $\mathbf{10}^3$ illustratively comprises a Bluetooth™ module, such as a Bluetooth™ smart 4.2 chip, as a component of their electronic circuits, thereby providing communication with other similarly equipped padlocks $\mathbf{10}^1$, $\mathbf{10}^2$, $\mathbf{10}^3$ via a Bluetooth™ mesh network. The padlocks $\mathbf{10}^1$, $\mathbf{10}^2$, $\mathbf{10}^3$ can also communicate with the Internet 176 via a wireless GSM/GPRS network. Additionally, the padlocks $\mathbf{10}^1$, $\mathbf{10}^2$, $\mathbf{10}^3$ can also communicate with the GPS satellite 178 via a wireless GPS network. In this regard, the padlocks $\mathbf{10}^2$ and $\mathbf{10}^3$ communicate via a Bluetooth™ mesh network with a mobile device 180, such as a smartphone or tablet or the like, which in turn can connect the padlocks 10 to the Internet 176 via the GSM/GPRS/GPS network.

A number of non-limiting examples of the possible applications of the described padlocks will be discussed below.

The padlocks 10 of the present application and as discussed above may be employed to secure temperature and humidity sensitive products, such as vaccines, blood plasma products, frozen pharmaceuticals and insulin, which must be stored and transported while temperature is maintained within specific ranges. For example, vaccines are shipped by truck from a supplier to customers in different locations must be stored in a cooled container (not shown) with a temperature between 2° C. and 8° C. Illustratively, the cooled container is secured closed using one of the described padlocks 10. A temperature sensor node 182 is placed inside the cold container for monitoring the temperature. Radio frequency signals from the temperature sensor node 182 are transmitted to the padlock 10 via a Bluetooth™ connection. The temperature and global positioning coordinate data are then transmitted in real time to the Internet by the GSM/GPRS/GPS module in the padlock 10 via wireless communication. If the temperature inside the cooled vaccine container is sensed at being outside the specific range, for example the transporter may be alerted by the padlock 10, for example via an SMS text message or the like. The information regarding the temperature and GPS coordinates of the entire journey can be retrieved from the memory of the padlock 10 or from the server 184 with which the padlock 10 is from time to time in communication. Additionally, in order to be opened the padlock 10 requires authorization via wireless communication or an authorised fingerprint, thereby limiting access to the cooled container. This feature may prevent, for example, theft of the container contents or replacement of the contents with counterfeit products.

Another application of the padlock 10 is in the transportation of fresh and frozen meat and seafood in trucks or cargo containers. Meat and seafood are usually stored and transported at temperatures between −18° C. and 4° C. The padlock may be used to lock the truck or container doors (not shown) to prevent unauthorized access. Several temperature sensor nodes 182 may be placed inside the truck or cargo container and transmit radio frequency signals via Bluetooth™ communication to the padlock 10. The padlock 10 receives the signals from the temperature sensor nodes 182, and subsequently transmits the information to the Internet 176 using the GSM/GPRS/GPS module in the padlock 10 via wireless communication. If the temperature inside the cold container is outside a requisite temperature range, notifications may be sent to interested parties via SMS text message or the like. Additionally, information as to temperature and GPS coordinates of a given journey can be retrieved from the memory of the padlock 10 or from the server 184.

Another use of the padlock 10 of the present invention is the storage and transportation of products that are sensitive to temperature and humidity, such as offset printing plates and inkjet printing inks. For example, most of the negative offset computer to plates, which can be imaged with near infrared, violet and ultra-violet lasers, are sensitive to high temperature and humidity and as such are usually stored in air-conditioned warehouses and transported in air-conditioned containers. The preferred temperature and humidity is below 25° C. and 60%, respectively. The padlock 10 can be used to lock the doors of such an air-conditioned warehouse or container for monitoring and prevention of unauthorized access. Several temperature nodes 182 and humidity sensor nodes 186 may be placed within each warehouse and transport container, which transmits radio frequency signals regarding temperature and humidity via Bluetooth™ communication to the nearby padlock 10. Upon reception, the padlock 10 retransmits the data to the Internet 176 via wireless communication using the GSM/GPRS/GPS module, for example. If the conditions inside the air-conditioned warehouse or container is outside the required temperature and humidity range, interested parties can be notified via SMS text message. Additionally, information regarding temperature, humidity and location of an entire journey can be retrieved from the memory of the padlock 10 or from the server 184 for later use.

Yet another application of the smart padlock in accordance with the present invention is for monitoring the temperature and moisture within modern greenhouses, which are equipped with several temperature, humidity, nitrogen and oxygen (gas) sensor nodes 188. The padlock 10 receives radio frequency signals from the gas sensors nodes 188 and then retransmits the signals to the Internet 716 via GSM/GPRS/GPS wireless communication for monitoring.

A further use of the padlock as disclosed is for securing, monitoring and tracking travel luggage (not shown). For example, the padlock 10 is used to lock checked luggage of a passenger travelling by air. As the smart padlock is electronically unlocked by authorized fingerprint and/or a radio frequency unlock signal from a mobile device, the passenger does not need to carry physical keys or memorize a combination as is required to use a conventional padlock.

Additionally, the padlock 10 can improve airport luggage inspection and security. Currently, if a conventional padlock is used to secure the zipper or closure on a piece of luggage, screening personnel are required to remove the padlock for internal inspection by cutting through the shackle. Specialized locks have been designed to enable screening personnel to unlock them using a range of master keys and reattach them to the luggage after inspection. However, due to the high variety of specialized locks on the market, issuing master keys for each type of specialized lock to all luggage screening personnel is both expensive and difficult to manage. Furthermore, an unauthorized person may gain access to a master key and open luggage to steal or place items inside without being detected. The padlock 10 can enhance airport security by enabling luggage screening personnel to open the padlock 10 and secured luggage for internal inspection using a secure radio frequency unlock signal from an authorized mobile device running an application developed specifically for use by luggage screening authorities. This system eliminates the need to issue physical master keys and additionally verifies and logs the identity of the authorized individual inspecting the luggage. The padlock may store its locked and unlocked status in memory, enabling the luggage owner to subsequently retrieve such information using a suitable Bluetooth™ enabled mobile device, for example. Additionally, the padlock 10 can monitor in real time its locked and unlocked status and notify a luggage owner by SMS text message when it is opened.

Furthermore, as the padlock of the present invention transmits radio frequency signals and GPS coordinates to a passenger's smartphone via Bluetooth™ communication, the passenger can check on the smartphone whether the luggage has in fact arrived in the cargo bay of the airplane. The radio frequency signals can be turned off using the smartphone before takeoff.

Another application of the third alternative embodiment of the padlock 174 of the present invention is for securing parked bicycles to racks, railings, poles, and other street furniture or structures. The bicycle padlock 174 can be electronically unlocked by authorized fingerprint and/or a radio frequency unlock signal from a mobile device, eliminating the need for a bicycle rider to carry physical keys.

Furthermore, a bicycle owner can authorize the padlock 174 to be opened by a radio frequency unlock signal initiated by additional mobile devices, enabling the owner to safely share the bicycle and monitor its use. For example, a bicycle owner rides his bicycle to work and secures it to a rack outside his office building using the padlock 174. A co-worker requests to borrow the bicycle via the smart padlock's accompanying mobile application. The owner can choose to accept or reject the co-worker's request. If the owner accepts the request in the mobile application, the co-worker's smartphone is authorized to open the padlock 174 using a radio frequency unlock signal and borrow the bicycle. Also, the smart padlock can monitor in real time its locked and unlocked status and notify the bicycle owner by SMS text message when it is opened.

In addition to securing the bicycle, the padlock 174 can be applied as a fitness and location tracker. The padlock 174, which can be attached to the bicycle frame during a bicycle ride, can track rider data, such as speed, distance, and route using the GSM/GPRS/GPS module. Also, by providing its global position coordinates, the padlock 174 can help the rider locate where the bicycle is parked. This data can be stored in the lock's memory and retrieved by the rider's mobile device.

A further application of the padlock is as an electronic seal.

Although the present invention has been described hereinabove by way of specific embodiments thereof, it can be modified, without departing from the spirit and nature of the subject invention as defined in the appended claims.

We claim:

1. A method for securing an item of luggage suitable for locking with a padlock, the method comprising:

attaching a padlock to the luggage to be locked, said padlock comprising:

a shackle comprising a heel end pivotally attached to a padlock body for rotation about a first axis perpendicular to a plane and a toe end opposite said heel end and moveable in said plane between a first position wherein said toe end is away from said body, and a second position wherein said toe end is received within a detent in said padlock body;

a detent mechanism comprising a stop for securing said toe end and an actuator for moving said stop in a direction parallel to said axis between a locked position wherein said toe end is secured by said stop and an unlocked position wherein said toe end is no longer secured by said stop; and electronics comprising a near field interface for controlling said actuator such that said stop is movable between said locked position and said unlocked position by a signal received via said nearfield communication network;

establishing a communication link between a smartphone executing a padlock control application and said nearfield interface using a near field network; and locking the luggage using said padlock by said padlock control application issuing a locking command.

2. The method of claim 1, further comprising subsequently unlocking said padlock and the luggage by establishing a communication link between said smartphone executing said padlock control application and said nearfield interface using said near field network and said padlock control application issuing an unlocking command.

3. The method of claim 1, wherein said near field network comprises a Bluetooth™ network.

4. The method of claim 1, wherein said shackle is elongate and u-shaped.

5. The method of claim 1, wherein said padlock body defines a threaded bore about a second axis parallel to said first axis, said second axis aligned with a center of said toe end when in said locked position, wherein said actuator comprises a stepper motor and said stop comprises a threaded locking cylinder mounted within said threaded bore and attached to a shaft of said stepper motor for rotation therewith and further wherein rotation of said stepper motor and said locking cylinder in a first direction moves said locking cylinder toward said toe end and rotation of said stepper motor and said locking cylinder in a second direction moves said locking cylinder away from said toe end.

6. The method of claim 1, wherein said padlock body defines a bore about a second axis parallel to said first axis, said second axis aligned with a center of said toe end when in said locked position, wherein said actuator comprises a solenoid and said stop comprises a pin attached to a shaft of said solenoid for movement therewith along said second axis and further wherein said solenoid is normally biased towards said toe end such that actuation of said solenoid moves said pin away from said toe end.

7. The method of claim 1, wherein said detent comprises a curved ridge for engaging a circumferential grove in said toe end when said toe end is in said locked position, thereby preventing said toe end from moving vertically.

8. The method of claim 1, wherein said padlock further comprises a sensor for detecting when said toe end is in said locked position.

* * * * *